US005800204A

United States Patent [19]

Niitsu

[11] Patent Number: 5,800,204

[45] Date of Patent: Sep. 1, 1998

[54] ELECTRICAL CONNECTOR FOR FLAT CABLE

[75] Inventor: Toshihiro Niitsu, Yokohama, Japan

[73] Assignee: Molex Incorporated, Lisle, Ill.

[21] Appl. No.: 703,916

[22] Filed: Aug. 22, 1996

[30] Foreign Application Priority Data

Nov. 9, 1995 [JP] Japan ..... 7-316136

[51] Int. Cl.[6] ..... H01R 9/07

[52] U.S. Cl. ..... 439/495; 439/499

[58] Field of Search ..... 439/495, 496, 439/499, 569, 67, 77, 607, 947

[56] References Cited

U.S. PATENT DOCUMENTS

D. 351,136 10/1994 Kurata ..... D13/147
4,509,811 4/1985 Amano et al. ..... 339/17
4,630,874 12/1986 Renn et al. ..... 439/495
5,281,169 1/1994 Kiat et al. ..... 439/607
5,378,172 1/1995 Roberts ..... 439/607

FOREIGN PATENT DOCUMENTS 7-106028 4/1995 Japan ..... H01R 23/68

*Primary Examiner*—P. Austin Bradley
*Assistant Examiner*—Tho D. Ta
*Attorney, Agent, or Firm*—Stephen Z. Weiss

[57] ABSTRACT

An electrical connector includes a slot for receiving a flat electrical cable. The connector includes an elongated dielectric housing having a housing wall defining one side of the slot. A plurality of terminals are mounted in the housing, with contact portions of the terminals spaced along the housing wall and projecting into the slot. A sheet metal support is mounted on the housing and has a support wall defining an opposite side of the slot. The sheet metal support is folded back onto itself to provide a double thickness for the support wall.

11 Claims, 4 Drawing Sheets

ELECTRICAL CONNECTOR FOR FLAT CABLE

FIELD OF THE INVENTION

This invention generally relates to the art of electrical connectors and, particularly, to an electrical connector for terminating a flat cable, such as the end of a flat flexible cable.

BACKGROUND OF THE INVENTION

In general, an electrical connector typically includes a dielectric housing (e.g. plastic) which mounts a plurality of conductive terminals having contact portions for making electrical connection with the terminals of a complementary mating connector, with electrical wires or cables or with a variety of other electrical devices. Some electrical connectors are elongated and include slots for receiving flat electrical cables, such as the distal ends of flat flexible cables having exposed, generally parallel conductors.

One of the continuing problems with elongated electrical connectors which receive flat cables is the problem of the connector housing bowing because of the interacting forces between the cable and the resilient contact portions of the terminals spaced along the elongated cable-receiving slot. Because of an ever increasing demand for reducing the thickness or size of such flat cable connectors, there is a tendency to reduce the thickness of the outer wall which defines one side of the cable-receiving slot opposite the contact portions of the terminals. Elongating the connector or reducing the thickness of the wall leads to an undesirable reduction in the strength of the wall, because the housing typically is fabricated as a unitary structure of plastic material.

The present invention solves this problem by providing a two-part housing with one part being plastic and the other part being sheet metal, and with the sheet metal part defining the wall along one side of the cable-receiving slot opposite the contact portions of the terminals. The metal wall is folded back onto itself to provide a double thickness of sheet metal material along the slot.

SUMMARY OF THE INVENTION

An object, therefore, of the invention is to provide a new and improved electrical connector which includes a slot for receiving a flat electrical cable.

In the exemplary embodiment of the invention, the connector includes an elongated dielectric housing having a housing wall defining one side of the slot. A plurality of terminals are mounted in the housing, with contact portions of the terminals spaced along the housing wall and projecting into the slot. A sheet metal support is mounted on the housing and has a support wall defining an opposite side of the slot. The sheet metal support is folded back onto itself to provide a double thickness for the support wall.

As disclosed herein, the dielectric housing includes a shelf extending along the opposite side of the slot. One thickness of the support wall extends beneath the shelf. Preferably, the support wall includes an outer thickness and an inner thickness, with the inner thickness being wider than the outer thickness to thereby extend beneath the shelf. The outer thickness is generally flush with the outside of the dielectric housing.

Still further, the sheet metal support includes end portions extending beyond opposite ends of the slot. Each end portion includes a support tab engageable with the housing and a solder tab for soldering to a solder pad on an appropriate printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
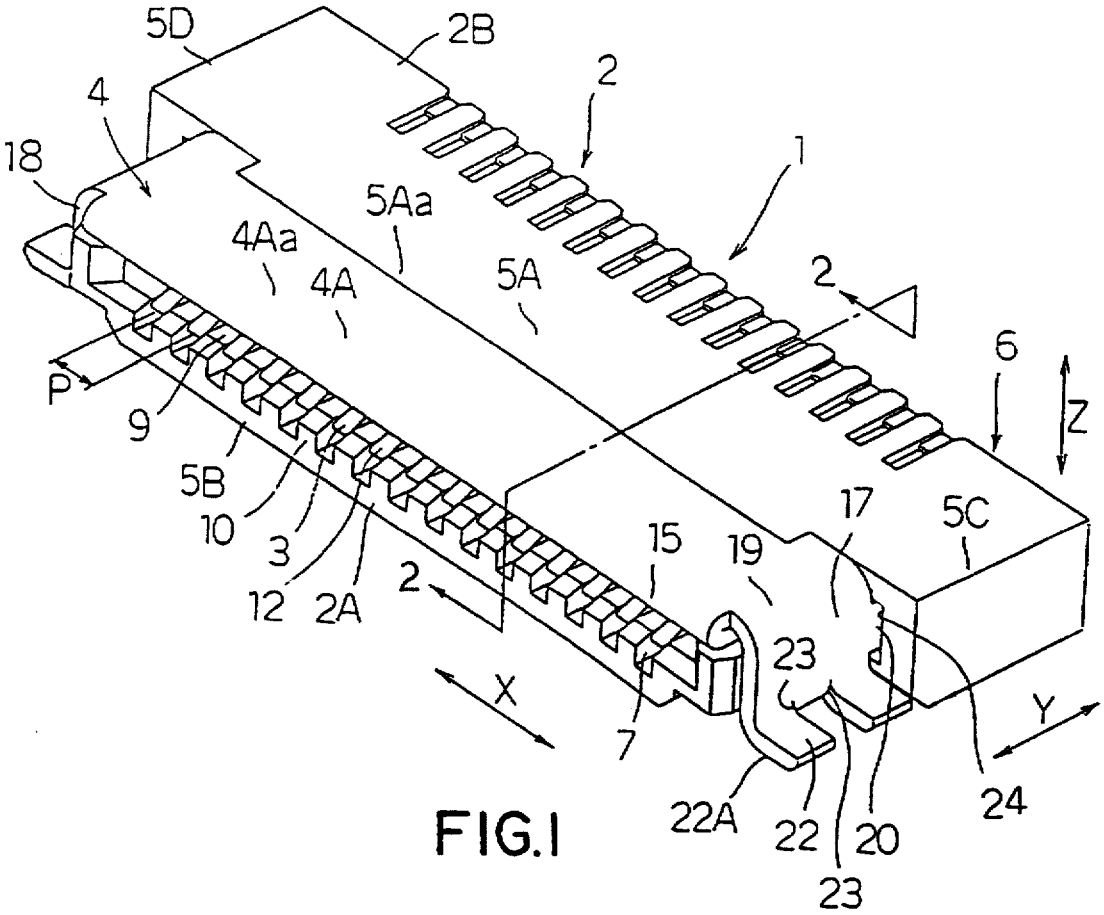
FIG. 1 is a perspective view of an electrical connector embodying the concepts of the present invention.

Referring to the drawings in greater detail, an electrical connector, generally designated 1, includes a dielectric housing, generally designated 2, mounting a plurality of terminals 3. The housing is a unitary structure molded of dielectric material such as plastic or the like. The housing is elongated in the "X" direction. The terminals are fixed to the housing and are arranged longitudinally thereof at regular intervals or spacings "P".

Housing 2 includes a housing body 6 having a top wall 5A, a bottom wall SB and opposite side walls 5C and 5D. The top and bottom walls extend longitudinally of the connector as indicated by double-headed arrow "X". The connector defines a cable-receiving slot 9 for inserting thereinto a flat electrical cable, such as a flat flexible cable 8 shown in FIGS. 7 and 8. Cable slot 9 opens at a front face 2A of housing 2. Bottom wall 5B of the housing includes a plurality of grooves 7 at spaced intervals in the "X" direction for receiving terminals 3. specifically, each terminal groove 7 is defined by two spaced side walls 10.

Figure 2:
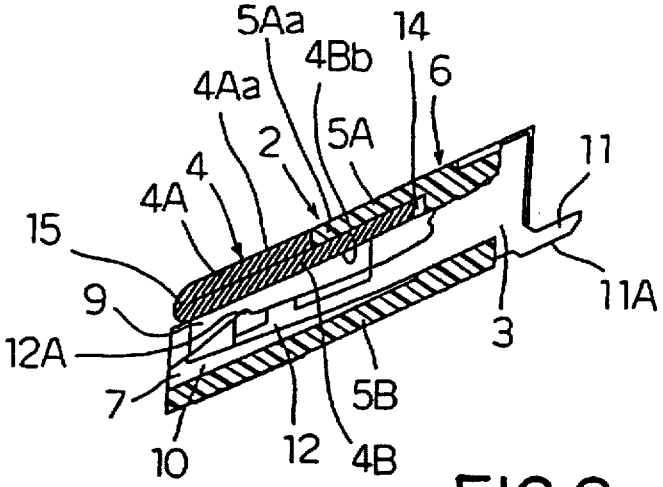
FIG. 2 is a vertical section taken generally along line 2—2 of FIG. 1.
Figure 3:
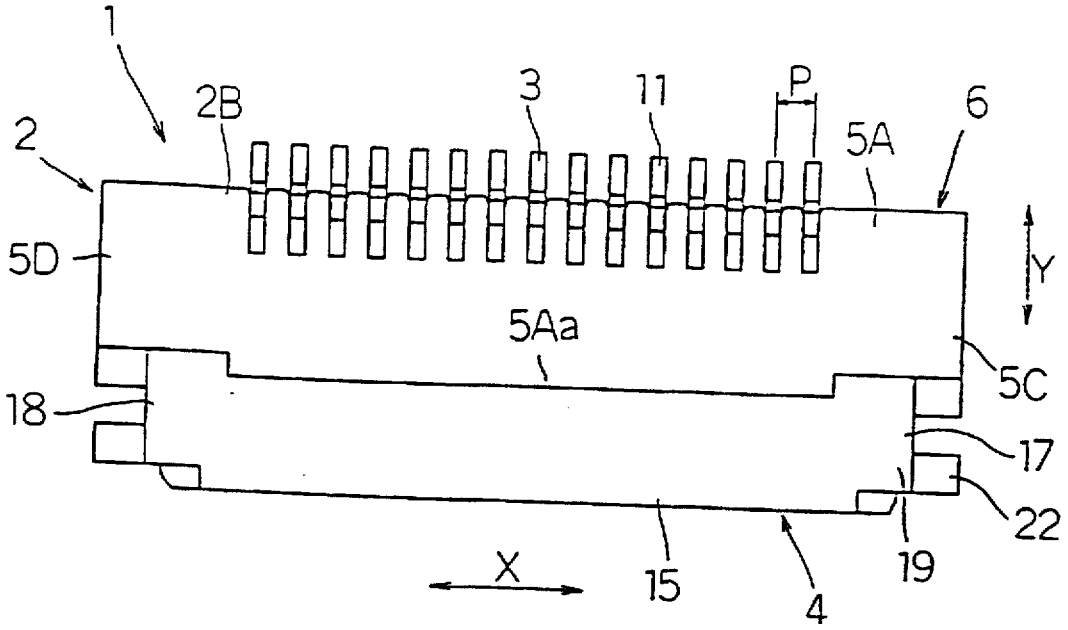
FIG. 3 is a top plan view of the connector.
Figure 4:
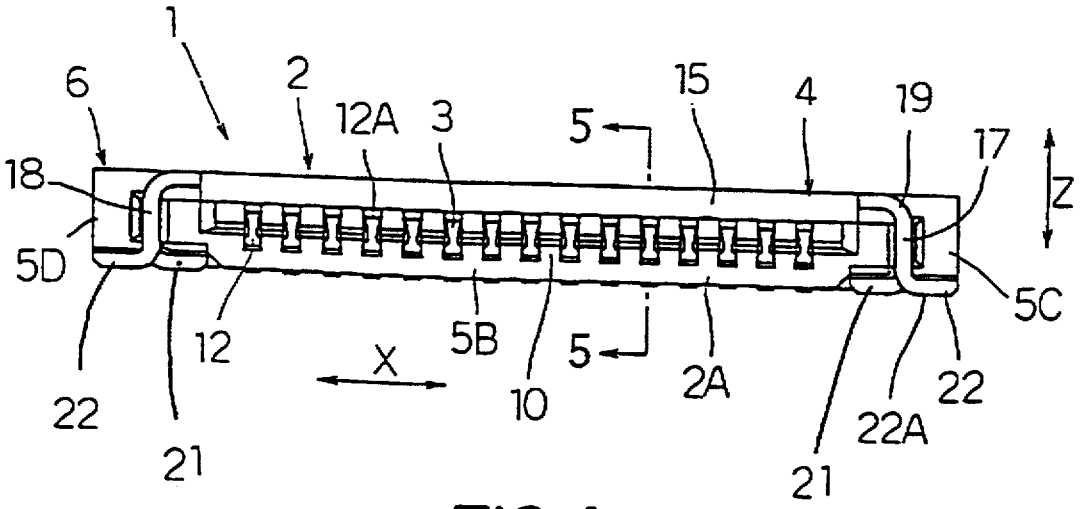
FIG. 4 is a front elevational view of the connector.
Figure 5:
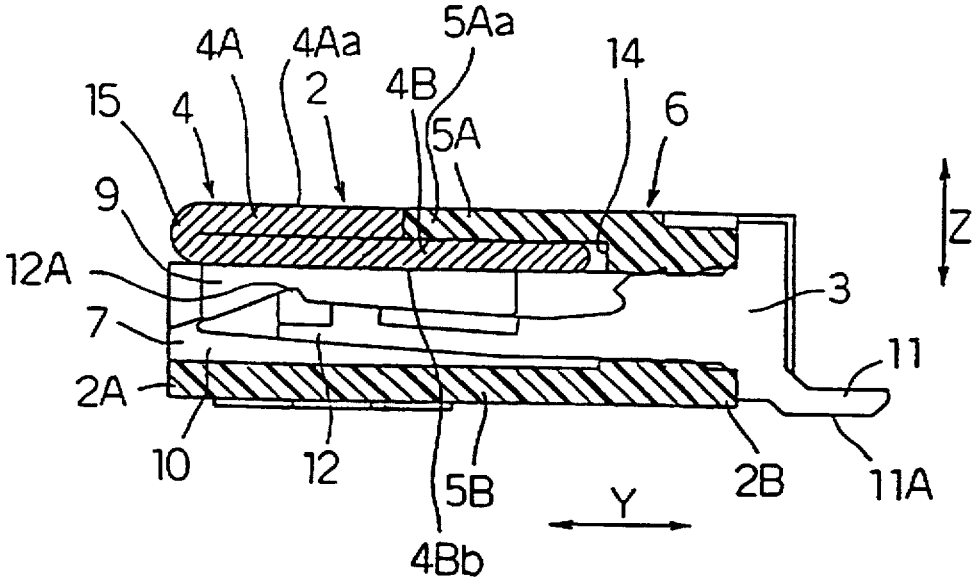
FIG. 5 is a vertical section taken generally along line B—B of FIG. 4.
Figure 6:
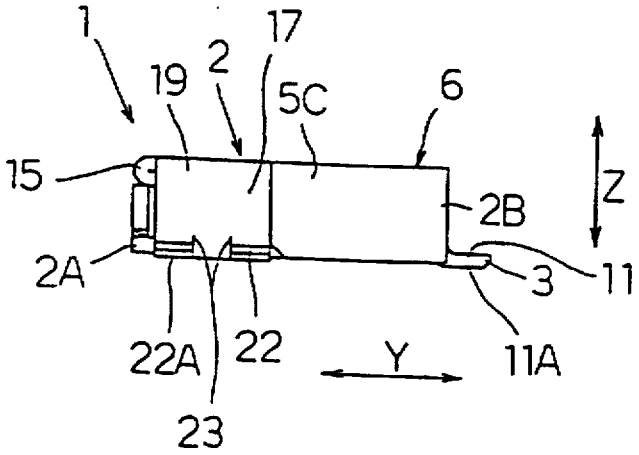
FIG. 6 is an end elevational view of the connector.

As seen best in FIGS. 2 and 5, each terminal 3 has an elongated contact 12 extending into slot 9 and a solder tail 11 projecting outwardly at the rear of the housing. Contact 12 extends laterally of the housing in a Y direction as indicated by double-headed arrow "Y" in FIG. 5. Contact 12 extends laterally in a forward direction from a rear face 2B to the front face 2A of the housing. The elongated contact 12 extends in terminal groove 7 and is resiliently deflectable in a Z-direction as indicated by double-headed arrow "Z". The contact has a contact point 12A for engaging a respective one of the parallel conductors 8A of one of the flat cables 8 shown in FIGS. 7 and 8. Soldering tail 11 of each terminal 3 extends in the Y-direction rearwardly of the housing and is adapted for soldering to an appropriate circuit trace on a typical printed circuit board.

A sheet metal support, generally designated 4, is mounted on housing 2 and, generally, defines a support wall at the opposite side of slot 9 from contacts 12 of terminals 3. The sheet metal support is folded back onto itself to define a double-thickness for the support wall. In particular, the sheet metal support is folded to define an outer thickness 4A and an inner thickness 4B, with the thicknesses being joined by a fold 15 of the sheet metal support. As best seen in FIGS. 2 and 5, inner thickness 4B is wider than outer thickness 4A of the sheet metal support. The outer thickness defines an outer surface 4Aa, and the inner thickness defines an inner surface 4Bb. Top wall 5A of the housing defines a shelf 5Aa extending along slot 9 on the side of the slot opposite contacts 12 of the terminals. The shelf defines a step-like recess 14 inside the housing. When sheet metal support 4 is fixed to the housing, wider inner thickness 4B extends into recess 14 beneath shelf 5Aa of top wall 5A of the housing. Therefore, upper surface 4Aa of outer thickness 4A faces outwardly and is flush with the top of the housing, whereas lower surface 4Bb of inner thickness 4B faces inwardly toward cable slot 9.

As seen best in FIGS. 1–4, sheet metal support 4 includes end portions 17 and 18 in the form of downwardly bent legs at opposite ends of the sheet metal support. The legs are bent, as at 19. Each end portion 17,18 includes an inwardly bent support tab 21 between a pair of outwardly bent solder tabs 22. In fabrication, the inwardly bent tab is formed out of a notch 23 (FIG. 1) between outwardly bent tabs 22. The inwardly bent support tabs 21 are engageable around portions of housing 2 beyond opposite ends of slot 9. The outwardly bent solder tabs 22 have lower surfaces 22A for soldering to solder pads on an appropriate printed circuit board.

Sheet metal support 4 is assembled to housing 2 by inserting inner thickness 4B into recess 14 beneath shelf 5Aa of the housing. At the same time, a pair of flanges 20 (FIG. 1) which project rearwardly of the sheet metal support, at opposite ends thereof, are inserted into slots 24 in the housing. Support tabs 21 then are bent inwardly to fix the sheet metal support to the housing.

In use, electrical connector 1 is surface mounted on a printed circuit board (not shown) with solder tails 11 of terminals 3 in alignment with selected circuit traces or conductors on the circuit board. The solder tails then are soldered to the circuit traces, thereby making the required connections between the bottom surfaces 11A of the solder tails with the printed circuit board. Also, bottom surfaces 22A of solder tabs 22 of sheet metal support 14 also are soldered to appropriate solder pads on the printed circuit board. The connector now is ready to receive a flat cable into slot 9.

Figure 7:
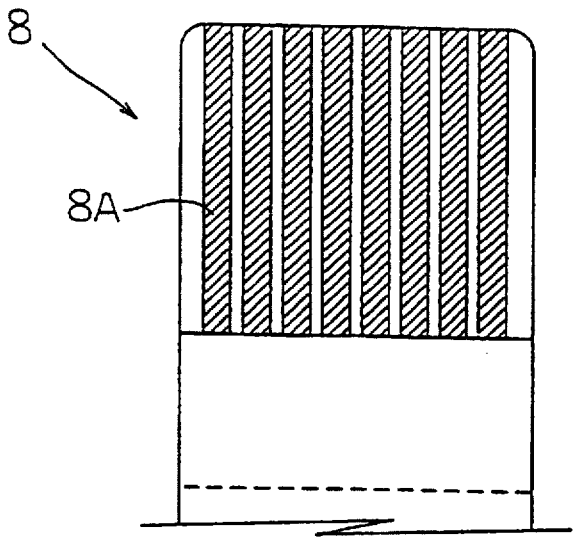
FIG. 7 is a plan view of the distal end of a flat flexible cable to be inserted into the connector.
Figure 8:
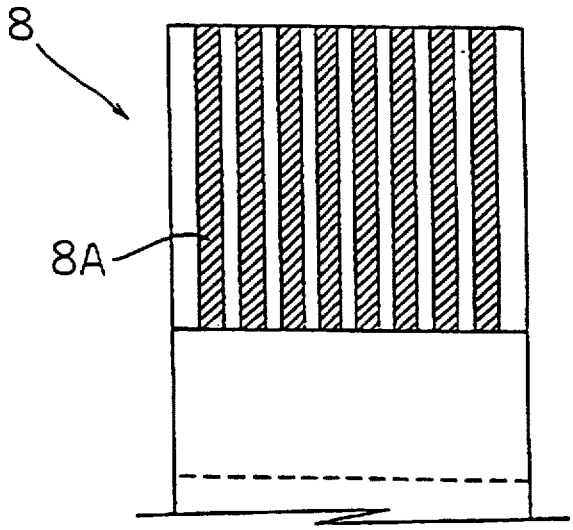
FIG. 8 is a plan view of the distal end of another type of flat flexible cable.

FIGS. 7 and 8 show the distal ends of a pair of flat cables, such as flat flexible cables, which are insertable into slot 9 of connector 1. Each cable 8 includes a plurality of laterally spaced, exposed conductors 8A which extend generally parallel to each other. When the distal end of one of the cables is inserted into slot 9, the exposed conductors 8A face downwardly and are aligned with contact points 12A of contacts 12 of terminals 3. The contacts are resilient and the flat cable is effective to force the contacts downwardly as the cable is inserted into the slot. Sheet metal support 14 is subjected to the counter action or reactive forces from the contacts, through the cable. Because the sheet metal support is fabricated of a double thickness of metal material, it is much stronger than the same thickness of plastic material and, therefore, the connector, particularly the upper wall of the connector, does not bow as a result of the reactive forces.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector which includes a slot for receiving a flat electrical cable, comprising:

an elongated dielectric housing having a housing wall defining one side of said slot;

a plurality of terminals mounted in the housing with contact portions spaced along the housing wall and projecting into the slot;

a sheet metal support mounted on the housing and having a support wall defining an opposite side of the slot, the sheet metal support being folded back onto itself to provide a double thickness for the support wall; and said dielectric housing including a shelf extending along said opposite side of the slot, and one thickness of the support wall extending beneath the shelf.

2. The electrical connector of claim 1 wherein said sheet metal support includes end portions extending beyond opposite ends of the slot, each end portion including a support tab engageable with the housing and a solder tab adapted for soldering to a pad on an appropriate printed circuit board.

3. The electrical connector of claim 1 wherein said support wall includes an outer thickness and an inner thickness, the inner thickness being wider than the outer thickness to thereby extend beneath the shelf.

4. The electrical connector of claim 3 wherein said outer thickness is flush with the outside of the dielectric housing.

5. An electrical connector which includes a slot for receiving a flat electrical cable, comprising:

an elongated dielectric housing having a housing wall defining one side of said slot, and a shelf extending along an opposite side of the slot;

a plurality of terminals mounted in the housing with contact portions spaced along the housing wall and projecting into the slot; and a sheet metal support mounted on the housing and having a support wall defining said opposite side of the slot, the sheet metal support being folded back onto itself to provide a double thickness for the support wall including an outer thickness and an inner thickness, the inner thickness being wider than the outer thickness and extending beneath the shelf of the housing, the sheet metal support including end portions extending beyond opposite ends of the slot, each end portion including a support tab engageable with the housing and a solder tab adapted for soldering to a pad on an appropriate printed circuit board.

6. The electrical connector of claim 5 wherein said outer thickness is flush with the outside of the dielectric housing.

7. The electrical connector of claim 5 wherein said support tab is bent inwardly in engagement with portions of the housing at opposite ends of the slot, and said solder tab is bent outwardly of the housing for soldering to the pad on the printed circuit board.

8. The electrical connector of claim 7, including a pair of said outwardly bent solder tabs, with said support tab being disposed therebetween.

9. An electrical connector which includes a slot for receiving a flat electrical cable, comprising:

an elongated dielectric housing having a housing wall defining one side of said slot;

a plurality of terminals mounted in the housing with contact portions spaced along the housing wall and projecting into the slot;

a sheet metal support mounted on the housing and having a support wall defining an opposite side of the slot, the sheet metal support being folded back onto itself to provide a double thickness for the support wall; and said sheet metal support including end portions extending beyond opposite ends of the slot, each end portion including a support tab engageable with the housing and a solder tab adapted for soldering to a pad on an appropriate printed circuit board.

10. The electrical connector of claim 9 wherein said support tab is bent inwardly in engagement with portions of the housing at opposite ends of the slot, and said solder tab is bent outwardly of the housing for soldering to the pad on the printed circuit board.

11. The electrical connector of claim 10, including a pair of said outwardly bent solder tabs, with said support tab being disposed therebetween.

* * * * *